United States Patent [19]

Clark et al.

[11] Patent Number: 4,513,025

[45] Date of Patent: Apr. 23, 1985

[54] LINE EMISSION PENETRATION PHOSPHOR FOR MULTICOLORED DISPLAYS

[75] Inventors: Thomas E. Clark, Acton; Charles T. Burilla, Southboro, both of Mass.

[73] Assignee: Sperry Corporation, New York, N.Y.

[21] Appl. No.: 377,120

[22] Filed: May 11, 1982

[51] Int. Cl.[3] ..... B05D 5/06; H01J 31/20

[52] U.S. Cl. ..... 427/68; 427/71; 427/214; 427/218; 427/220; 427/399

[58] Field of Search ..... 427/64, 68, 214, 71, 427/73, 218, 220, 399

[56] References Cited

U.S. PATENT DOCUMENTS

| | | | |
|---|---|---|---|
| 3,275,466 | 9/1966 | Kell | 427/68 |
| 3,886,394 | 5/1975 | Lipp | 427/68 X |
| 3,939,377 | 2/1976 | Ignasiak | 427/68 X |
| 4,071,640 | 1/1978 | Ignasiak | 427/68 X |
| 4,219,587 | 8/1980 | Oba et al. | 427/68 X |
| 4,264,677 | 4/1981 | Koyama et al. | 427/218 |

*Primary Examiner*—Richard Bueker

*Attorney, Agent, or Firm*—Howard P. Terry

[57] ABSTRACT

A single particle penetration phosphor employs $La_2O_2S$:Tb particles as a core particle having a thin layer of $La_2O_2SO_4$:Tb formed thereon by oxidation to provide a barrier which must be penetrated by excitation electrons to produce narrow bandwidth green spectral emission from the particle. The thin barrier is in turn coated by a layer of $YVO_4$:Eu particles which produce narrow bandwidth red spectral emission upon electron excitation. The barrier layer increases the voltage turn on characteristic of the green carrier host thereby causing the electron irradiated phosphor to radiate in the red spectrum for low voltages and in the green spectrum for higher voltages. Additionally, methods are disclosed for synthesizing the above single particle penetration phosphor.

11 Claims, 4 Drawing Figures

LINE EMISSION PENETRATION PHOSPHOR FOR MULTICOLORED DISPLAYS

BACKGROUND OF THE INVENTION

1. Field of the Invention

The invention pertains generally to the field of cathodoluminescent phosphor materials and to cathode ray displays employing them and more particularly concerns improved single particle penetration phosphors for use in bright color display cathode ray indicators.

2. Description of the Prior Art

Multicolor penetration phosphor cathode ray tubes enjoy a wide range of applications in modern display systems. In the case of avionics displays, the particular requirement of such systems are generally not met by cathode ray tubes of the types conventionally used for color television viewing. In avionics displays the system must be designed to operate under the extreme condition of sunlight falling perpendicular to the faceplate at approximately 10,000 foot candles, as well as the more typical lighting level of daytime light of approximately 100 foot candles. Display readability under high lighting levels is normally maintained by increasing the display brightness and employing a contrast enhancement device. For a given penetration phosphor screen, however, increased brightness, which is obtained by increasing the beam current density, will lead to a decreased screen lifetime. This fact, coupled with limitations in the coulomb ratings, luminous efficiencies and designed operating voltages for a state of the art multicolor penetration phosphor has led to the employment of directional filters in order to simultaneously meet display readability requirements and obtain satisfactory screen lifetimes. The use of directional filters, however, has the disadvantage of requiring the viewer to carefully position his head with respect to the display in order to take advantage of the improved light transmission.

In prior art embodiments phosphors having both wide and narrow emission spectra have been used in combination with selective narrow bandpass filters, which do not suffer the disadvantage described above for the directional filters. The use has, however, been limited by the lack of a penetration phosphor with acceptable cathodoluminescent properties, since in addition to filtering out unwanted wavelengths of light such as is contained in sunlight, these filters may also filter out a large portion of the phosphor's emission.

While several kinds of color television cathode ray tubes are currently available, including the older type with a mask with round holes, the inline slot mask color tube, and the recent slit mask color tube, all of these use multiple guns and complex electron beam focusing and scanning arrangements and are generally not suited for use in information displays, especially where random deflection is needed. Resolution is poor, and sensitivity to external magnetic fields is undesirably high. Because they require multiple cathode and multiple electrode systems, sensitivity to shock and vibration may also be a problem.

While originally conceived for use in color television receiver displays, the penetration phosphor color tube and the principles it employs offer several advantages for use in information displays.

Conventional penetration phosphor cathode ray tubes in their most prevalent form exploit the ability to control the depth of electron penetration into the phosphor screen of the CRT by adjusting the voltage of electron beams incident upon the multilayered phosphor system. Thus, at low voltages, only the phosphor closest to the electron source is excited, yielding an output color corresponding to its emission. At the highest voltages, inner layers are also excited yielding an output color that is determined by the relative emission intensities from the contributing phosphors. Intermediate voltages then give rise to different relative emission intensities and hence different colors.

Of the various possible approaches for constructing the requisite multilayered phosphor system, those utilizing multilayered powdered particles have received considerable attention for reasons of enhanced luminous efficiencies or ease of subsequent tube manufacture. One early version of a mixed two component system using red and green emitting phosphors involved the formation of a non-luminescent "onion skin" on the surface of a green emitting ZnS:Cu powder particles. This dead layer green (DLG) component was then mixed with commercially available red emitting phosphor, allowing the preparation of a multicolor phosphorous screen using the same procedure employed in monochrome tube preparation. ZnS:Cu powder is not ideally suited for use in high contrast displays because of its reduced luminous efficiency under the high current density conditions found in these displays. Furthermore, it is not ideally suited for use with selective filters because of the broad band nature of its emission as discussed above.

In Another approach an efficient penetration phosphor consisted of a $Zn_2SiO_4$:Mn core particle covered with a non-luminous layer on top of which was a coating of small red emitting $YVO_4$:Eu particles. These penetration phosphors, however, also use a broad band green emitting phosphor which reduces their suitability for use with selective, contrast enhancement filters.

In another embodiment of a single particle penetration phosphor system containing only line emitting phosphor components, the preparation involved a controlled sulfidization or $R_2O_3$:Pr, where the R could be yttrium or gadolinium, particles to yield a core of red emitting $R_2O_3$:Pr in a contiguous surface layer of green emitting $R_2O_2S$:Pr. Although the narrow band aspect of the component phosphor emissions makes this system well suited for use with selective filters, the availability of alternative red and green emitting phosphor components with superior cathodoluminescent efficiencies and color saturation provides a opportunity for improvements in system performance. The present invention provides for a single particle penetration phosphor system utilizing phosphor having superior cathodoluminescent efficiencies and color saturation characteristics to provide for improvement over prior art penetration phosphor systems.

SUMMARY OF THE INVENTION

The present invention comprises a novel penetration phosphor in an optimized single particle configuration. In particular, these penetration phosphors are comprised of a multilayered powdered grain having a core of green emitting $La_2O_2S$:Tb which is carefully oxidized to provide a thin barrier peripheral region of $La_2O_2SO_4$:TB. Relatively smaller particles of red emitting $YVO_4$:Eu are used to coat the surface of the larger core particles. The barrier or peripheral region will only weakly emit illumination when excited by an electron beam and cause the core particles to emit illumination at a higher voltage than the coating particles.

DESCRIPTION OF THE PREFERRED EMBODIMENT

Figure 1:
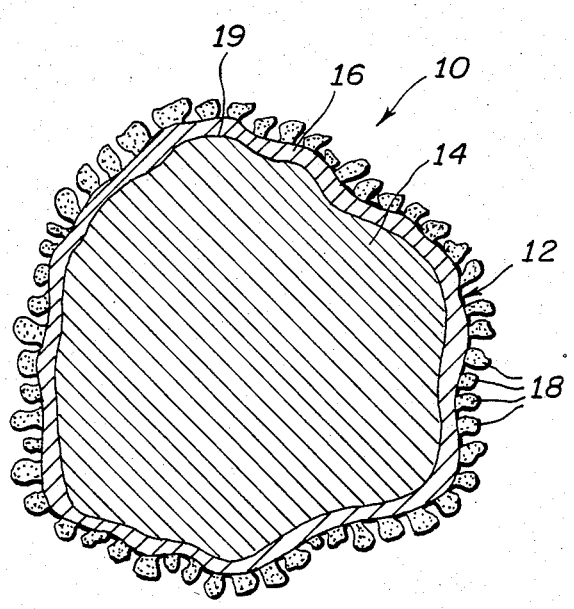
FIG. 1 is a cross-section view of a representative phosphor particle according to the invention.

Referring now to FIG. 1, a cross section of a single particle cathodoluminescent penetration phosphor 10 according to the present invention is illustrated. In particular, the novel penetration phosphor 10 of the present invention is utilized in particulate form and comprised of a relatively large core particle 12 which is in turn comprised of a central luminescent region 14 and a non-luminescent "onion skin" surface or barrier layer 16. Large core particle 12 is further covered with relatively small luminescent particles 18. The central region 14 is comprised substantially of a host material, $La_2O_2S$ with a uniform distribution of an activator therethrough, such as terbium (Tb) ions $La_2O_2S$:Tb, which is a narrow band green emitting phosphor known in the art. Beginning with interface 19, the central region 14 is generally uniformly surrounded by the onion skin layer 16 which is comprised substantially of lanthanum oxysulfate ($La_2O_2SO_4$) having a homogeneous distribution of activator ions (Tb) there through $La_2O_2SO_4$:Tb. Small particles 18 are comprised of $YVO_4$:Eu which is a narrow band red emitting phosphor known in the art.

Figure 2:
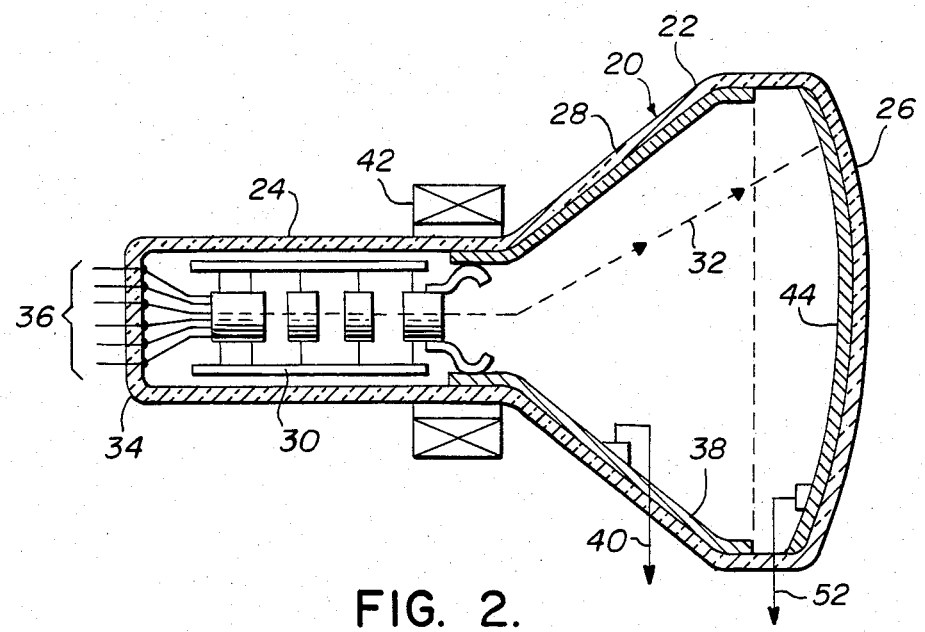
FIG. 2 is a cross-section view of a representative cathode ray vacuum tube display in which the novel phosphor particle may be used.

The present penetration phosphor has been designed for use as a luminescent screen in a cathode ray tube such as it is shown in FIG. 2. The tube 20 consists of a vacuum envelope 22 including a neck 24, a viewing face plate 26 and a conically shaped transition section 28 for completing the vacuum envelope. An electron gun 30 is supported within the neck 24 and is adapted to project an electron beam represented by the dotted line 32 toward an inner surface of the faceplate 26. The neck 24 is closed at its end opposite the face plate 26 by a stem structure 34 through which a plurality of lead in wires 36 are sealed. Suitable operating potentials may be applied to the electron gun 30 and then to its associated cathode through the conductors 36. A conducting coating 38 is provided on the internal surface of the conical section 28 of envelope 22 and serves as an accelerating electrode for electron beam 32. A suitable high voltage is applied from a conventional power supply (not shown) to the conducting coating 38 by a terminal sealed through the glass cone 28, as represented at 40. A magnetic deflection yoke 42 or other conventional electron beam deflection means is provided for positioning electron beam 32 with respect to faceplate 26.

Figure 3:
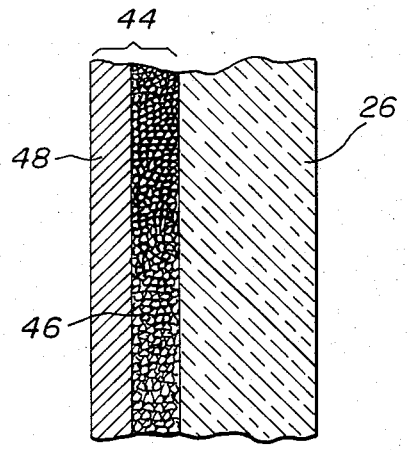
FIG. 3 is a magnified cross-section view of the screen element of FIG. 2.

The screen of the present invention is supported on the faceplate 26 so that the deflected electron beam 32 may excite the phosphor particles comprising screen 44 to the luminescent state. FIG. 3 illustrates in greater detail the luminescent screen 44 which is composed in part of a layer 46 of the cathodoluminescent penetration phosphor particles of the present invention. The layer 46 is characterized by including many particles and is substantially free of voids. A light reflecting metal layer 48 is supported upon layer 46. Metal layer 48 is thin and composed of a metal such as aluminum so that it may be readily penetrated by the electrons of beam 32. The display tube 20 may be provided with a mesh grid 50 located traversely within conical section 28. If mesh grid 50 is used, it is connected electrically to the conductive coating 38 so that the display tube may operate according to conventional post acceleration principles. A separate lead in conductor, as represented at 52, may be supplied for providing a suitable electrical potential to metal layer 48, such as post acceleration potential, whereupon mesh grid 50 may be eliminated entirely.

Operation of the invention may be described with reference to FIGS. 1, 2 and 3. Low velocity and hence low energy electrons of beams 16 present therein when a relatively low accelerating voltage is applied to terminal 40, strike the surfaces of the single particle phosphor comprising layer 46. The low velocity electron striking the phosphor particles will excite only the outer layer of red emitting $YVO_4$:Eu particles, thus causing a red spectral emission to emanate from the phosphor particles. Very little emission will emanate from the core particle 12 since the electrons have insufficient energy to penetrate the onion skin layer 16 which, because of its crystalline structure, will at best only weakly emit luminescence therefrom. As the acceleration voltage at terminal 40 is increased, electrons in the beam 32 will have a sufficient energy to penetrate to core particle 12 and induce a narrow bandwidth, green spectral emission from the central region 14 of each penetration phosphor 10.

The red surface particles 18 will also, however, continue to emit radiation. Accordingly, as acceleration voltage at terminal 40 is increased towards its maximum value, the gradual increase in green emission from the central region 12 of each penetration phosphor will induce a color change from red to orange to yellow and finally to a substantially green light. In this fashion, it is possible to obtain color variation from the CRT by simply changing the voltage applied to terminal 40. The degree of generation of red or green light will also be controlled by the composition of phosphor particles 10.

The color and brightness characteristics of this system as a function of voltage will be critically dependent upon the specific phosphor material design. Thus once a specific phosphor system or particular application has been selected and a comparative scheme established, the performance of that phosphor system should be optimized as the application requires.

The optimization sequence includes four steps: (1) optimizing the surface coverage by the coating particles 18 per coating application, (2) selection of a preferred particle size for the core particle material 12, (3) maximizing the red component brightness and (4) maximizing the working voltage for the red mode. These steps are discussed in detail as follows.

Optimization of the coating coverages includes adjusting the pH of the dispersion in which the small particles 18 are contained and the length of time that the core particles were exposed to the small particle dispersion. It has been found that coating particle diameters of substantially one micron but ranging from less than 0.5 micron to greater than 2 microns provides satisfactory performance.

The core particle 12 size has also been found to influence the brightness versus voltage in the red mode caused by luminescence of the coating particle phosphor. Additionally, the density of phosphor layer 46 known as the screen loading density must also be taken into consideration. For example, it has been found that for core particles having a range of substantially 16–20 microns, a screen loading density of 6.8 milligrams/$cm^2$ provides the highest brightness for an electron beam having a given accelerating voltage.

As the accelerating voltage, and therefore electron penetration, is increased, the ratio of beam energy absorbed in luminescent versus non-luminescent material will become dependent upon the core particle size. For the limit of the very small diameter core particle, the phosphor screen would appear to the electron beam to be comprised essentially of a multi-particle thick layer of small luminescent coating particles. The brightness in such a case would show a linear dependence upon voltage similar to that found for the pure coating particles. At the other extreme of a very large diameter core particle, the phosphor screen would appear to the electron beam to consist of a mono particle thick layer of the small coating particles. The shape of the brightness versus voltage curve in such a case will be similar to that found and known in the art for thin luminescent films.

Luminous efficiency of the red emitting component in the penetration phosphor should be maximized, the only limitation on the number of coating layers used being the ability to produce a green color output at an acceptable working voltage. It has been found that with more than one coating layer of particles substantially in the 0.5 micron to 2 micron range, the desired green output at high working voltages is shifted to yellow. This is due, in part, to increased red emission from the thicker luminescent coating layer. It is, however, also due to the diminished green emission from the core particle which results from the reduced beam energy reaching the core in the double layered material.

Finally, the highest possible red mode working voltage was obtained so as to yield a maximum red brightness at a given beam current density. To accomplish this, the core particle with the thickest barrier layer that would still yield an acceptable green output within 15 kilovolts is desirable.

As core particle oxidation time and therefore the thickness of barrier layer 16 is increased, the color of luminescence will shift towards the red, since there is a reduction in green emission from the core particle as the barrier layer thickness increases. Indeed, if the oxidation time were increased sufficiently, eventually all emission would be attributable to the red emission of the coating particles. The brightness with selected beam voltages will also decrease with an increase in oxidation time. This is also due to the reduction in green emission as the barrier layer 16 thickness is increased. A barrier layer 16 thickness substantially in the range of 0.5 to 1 micron has been found to be optimal.

Increasing the red mode voltage will ordinarily reduce the green output color at a particular voltage. Thus increasing the red mode working voltage will lead to the necessity of an increased green mode working voltage. It has also been found that increasing the red mode voltage also leads to an increase in the minimum voltage change required to produce both red and green colors.

Figure 4:
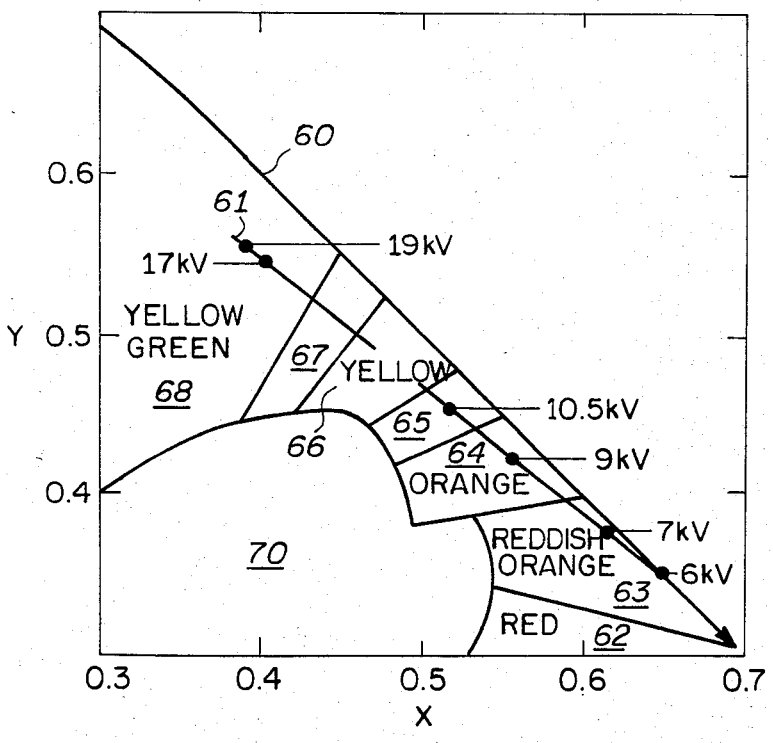
FIG. 4 is a chromaticity diagram showing the voltage characteristics of the preferred embodiment of the phosphor particle of the present invention.

A phosphor based on the foregoing considerations has been shown to produce the color ranges shown in chromaticity diagram of FIG. 4. Line 60 shows a boundary for pure spectral colors from a standard chromaticity diagram, and line 61 shows the colors obtained from the phosphor of the present invention at different accelerating voltages. Regions 62, 63, 64, 65, 66, 67 and 68 indicate the different colors shown by light having the x and y coordinates as bounded thereby. Region 70 surrounds the white region in which illuminant C, known in the art, is found. As can be seen from the chromaticity diagram, the colors emitted by the phosphor show excellent purity or saturation. The colors of illumination in the region of 6 kilovolts being substantially a pure spectral color departing therefrom by only small amounts at higher accelerating voltages.

SYNTHESIS

A sample of the novel penetration phosphor according to the present invention may be produced in the following manner. A ten gram sample of $La_2O_2S$:Tb known commercially as phosphor P-44 should be size classified to remove particles smaller than 16 micrometers in diameter. This sample should then be oxidized in a rotating quartz chamber for 60 minutes at 749° C. A moist oxygen flow of 20 cc/min should be maintained during the reaction and although experimental data indicate a negligible oxidation rate below 500° C., a blanket of argon may be kept over the material during the complete preheat and cool down periods. The core particle 12 of FIG. 1 is thus formed having a requisite barrier layer of $La_2O_2SO_4$:Tb.

Fifty millimeters of a 1% stock solution of gelatin is then diluted with water to 500 millimeters, clarified by warming to 30° C. and acidified with glacial acetic acid to a pH in the range of 3 to 5, preferably 4.0. Fifty millimeters of acidified gelatin solution may then be placed in a 75 millimeter polyethylene bottle containing 5 grams of the core phosphor particles, agitated for 25 minutes, settled and the supernatant removed by aspiration. This is in turn followed by several, approximately 5 to 6 water washes, to remove excess gelatin. A liquid dispersion of the small red phosphor particles, prepared by ultrasonically agitating 1.65 grams of $YVO_4$:Eu in 50 milliliters of water and acidifying to a pH of 3.9 may then be added to the oxidized core particles, agitated 25 minutes, settled, and the supernatent removed by aspiration. The $YVO_4$:Eu phosphor is of a type available commercially from Levy West Laboratories, Division of Derby Luminescence Ltd., Millmarsh Lane, Brimsdown, Enfield, Middlesex, England EN3-76W. It has been found that a mixture of approximately 3 parts by weight of core particle to one part by weight of coating particle is sufficient to provide adequate coating coverage. Following two water washes, a second coating of gelatin is applied to the coated particles and the excess gelatin is again removed with water washes. Following a wash with 37% formaldehyde solution to harden the gelatin, excess nonadhering small phosphor particles are removed by washing with ethanol. Finally, the material is air dried, lightly crumbled and sifted through a 30 micrometer sieve.

The phosphor as thus synthesized may then be applied to a screen of a cathode ray tube, such as that illustrated in FIG. 2 using techniques known in the art.

While the invention has been described in its preferred embodiments, it is to be understood that the words which have been used are words of description rather than limitation and that changes may be made within the purview of the appended claims without departing from the true scope and spirit of the invention in its broader aspects.

We claim:

1. A method for making a coated cathodoluminescent line emission penetration phosphor particle having a central region consisting of $La_2O_2S$:Tb, a non-luminescent barrier region substantially uniformly surrounding said central region consisting substantially of $La_2O_2SO_4$:Tb and forming a core particle with said central region and a layer of coating particles consisting substantially of $YVO_4$-Eu surrounding said barrier region, comprising the steps of:

selecting a host material consisting of particles of $La_2O_2S$:Tb with a diameter greater than the diameter of said coating particles;

oxidizing ones of said host particles to form said barrier region thereover in a thickness of about 0.5 to 1 micron thereby forming a plurality of core particles;

acidifying a first solution of gelatin with glacial acetic acid to pH in the range of 3 to 5;

agitating said core particles in said first acidified gelatin solution in a concentration of 0.1 gm/ml for a period of about 25 min. to apply a first gelatin coating;

removing an excess of said first acidified gelatin solution;

selecting a quantity of $YVO_4$:Eu substantially free of absorptive film material and having a ratio by weight to said core particles of about 1:3 and a particle size of about 0.5 to 2 microns and agitating in an aqueous solution having a pH of about 3.9;

agitating said core particles in said aqueous solution and said coating particles for about 25 min. sufficient to cause said coating particles to coat said core particles in at least a single layer thickness; and removing an excess of said aqueous solution from said core and said coating particles in said aqueous solution.

2. The method according to claim 1 further comprising the steps of:

applying a second acidified gelatin solution to provide a second coating of gelatin to said coating particle coated core particles; and removing an excess of said second coating gelatin.

3. The method according to claim 2 comprising the additional step of hardening said second coating of gelatin.

4. The method according to claim 3 comprising the further step of:

air drying said coated particles;

crumbling said air dried coated particles; and sifting said air dried coated particles through a 30 micron sieve.

5. The method according to claim 4 wherein the step of oxidizing comprises oxidizing in a quartz chamber having a moist oxygen flow of approximately 20 cc/mm at 749° C. for 60 minutes.

6. The method according to claim 5 further including the step of placing an argon atmosphere in said quartz chamber during preheat and cool down periods.

7. The method according to claim 5 wherein said hardening step comprises the step of washing in a 37% formaldehyde solution.

8. The method according to claim 7 wherein excess gelatin from said first and second gelatin coatings is removed by a plurality of water washes and excess of said first and second acidified gelatin solution and said aqueous solution is removed by aspiration.

9. The method according to claim 1 wherein the steps of removing excess acidified gelatin solution and acidified aqueous solution is by aspiration.

10. The method as set forth in claim 1, in which said host particles are comprised of particles substantially 16 to 20 micron in diameter.

11. A method for making a coated cathodoluminescent particle having a central region consisting of $La_2O_2S$:Tb, a non-luminescent barrier region substantially uniformly surrounding said central region consisting substantially of $La_2O_2SO_4$:Tb and forming a core particle with said central region, and a layer of coating particles consisting substantially of $YVO_4$:Eu surrounding said barrier region, comprising the steps of:

selecting a host material consisting of particles of $La_2O_2S$:Tb of a size substantially greater than and luminescing in a color different from than said coating particles;

oxidizing ones of said host particles to provide said barrier region, thereover and form said core particles;

acidifying a solution of gelatin with glacial acetic acid to pH in the range of 3 to 5;

agitating a preselected amount of said oxidized core particles in said acidified gelatin solution for a preselected period, said amount and said period sufficient for deposition in a useful quantity on a cathodoluminescent screen;

removing an excess of said acidified gelatin solution;

selecting a quantity of $YVO_4$:Eu substantially free of absorptive film material and having a predetermined ratio by weight to said oxidized core particles sufficient to provide adequate coating coverage of said oxidized core particles in substantially a single layer thickness and agitating in an aqueous solution having a preselected acidic pH;

agitating said oxidized core particles in said aqueous solution and said coating particles for a preselected period sufficient to cause said coating particles to coat said oxidized core particles in at least a single layer thickness; and removing an excess of said aqueous solution from said oxidized core and said coating particles in said aqueous solution.

* * * * *